United States Patent [19]

Poulsen

[11] Patent Number: 4,582,100

[45] Date of Patent: Apr. 15, 1986

[54] FILLING OF ACETYLENE CYLINDERS

[75] Inventor: Bo Poulsen, Copenhagen, Denmark

[73] Assignee: AGA, A.B., Cleveland, Ohio

[21] Appl. No.: 429,490

[22] Filed: Sep. 30, 1982

[51] Int. Cl.[4] ..... F17C 5/06

[52] U.S. Cl. ..... 141/4; 141/82; 141/83

[58] Field of Search ..... 73/714; 141/3, 4, 14, 141/82, 83, 94, 95, 96, 105, 197; 206/0.6, 0.7; 340/591, 592, 611, 613, 614, 626, 666

[56] References Cited

U.S. PATENT DOCUMENTS

| | | | |
|---|---|---|---|
| 291,769 | 1/1884 | Portillo | 73/714 |
| 1,105,157 | 7/1914 | Pearce et al. | 199/19 |
| 2,075,408 | 3/1937 | Sholes | 141/82 X |
| 2,343,545 | 3/1944 | Ford et al. | 73/714 X |
| 2,421,460 | 6/1947 | Merker et al. | 22/3 C |
| 2,498,401 | 2/1950 | Duncan | 119/14.09 |
| 2,587,839 | 3/1952 | Grise | 141/96 |
| 2,613,462 | 10/1952 | Johnson | 40/307 |
| 2,671,590 | 3/1954 | McBean et al. | 141/3 |
| 2,959,023 | 11/1960 | Webster | 62/45 |
| 3,659,428 | 5/1972 | Kunioka et al. | 62/64 |
| 3,680,967 | 8/1972 | Englehardt | 366/246 |
| 3,831,006 | 8/1974 | Chaffin, III et al. | 255/375 |
| 4,010,623 | 3/1977 | Kaschak | 62/55 |
| 4,053,001 | 10/1977 | Healy et al. | 141/83 X |
| 4,350,186 | 9/1982 | Schalkowsky et al. | 141/83 |

FOREIGN PATENT DOCUMENTS

| | | | |
|---|---|---|---|
| 2640842 | 10/1976 | Fed. Rep. of Germany | 141/4 |
| 1417235 | 10/1965 | France . | |
| 2422901 | 11/1979 | France | 141/83 |
| 370272 | 10/1974 | Sweden . | |
| 7212223 | 10/1974 | Sweden | 141/82 |
| 2030972 | 4/1980 | United Kingdom . | |
| 2077555 | 12/1981 | United Kingdom . | |

OTHER PUBLICATIONS

AGA Gas, Inc., LC Valve Protector Brochure.

*Primary Examiner*—Stephen Marcus
*Assistant Examiner*—Mark Thronson
*Attorney, Agent, or Firm*—David A. Burge

[57] ABSTRACT

Pressurized cylinders are rapidly filled with acetylene gas and solvent in a staged process that is closely monitored by a control unit to assure that filling progresses with all critical variables maintained within safe bounds. An operator performs certain preliminary cylinder hookup tasks as monitored and prompted by the control unit. The control unit conducts the actual filling of the cylinder, carrying out this procedure in distinct filling stages with alternate injections of solvent and gas into the cylinder. The improved system enhances the safety and efficiency with which acetylene cylinders are filled.

70 Claims, 6 Drawing Figures

FILLING OF ACETYLENE CYLINDERS

CROSS-REFERENCE TO RELATED APPLICATIONS

Reference is made to the following related, concurrently-filed applications, the disclosures of which are incorporated herein by reference:

METHOD AND APPARATUS FOR COOLING SELECTED WALL PORTIONS OF A PRESSURIZED GAS CYLINDER DURING ITS FILLING, Ser. No. 428,905 filed Sept. 30, 1982, by Bo Poulsen, hereinafter referred to as the "Cooling System Case," and, ENCODED PROTECTIVE CAP FOR A PRESSURIZED GAS CYLINDER, Ser. No. 428,633 filed Sept. 30, 1982, by Bo Poulsen, hereinafter referred to as the "Fixed Cap Case."

BACKGROUND OF THE INVENTION

1. Field of the Invention

The present invention relates to improved methods and apparatus for the filling of acetylene gas cylinders.

2. Prior Art

As is well known, acetylene gas is relatively unstable at high pressures and cannot be transported safely in such open-chambered cylinders as are used to transport other industrial gases. For safety reasons, acetylene is usually transported in elongate steel cylinders of a specialized type, each containing a porous mass within which a solvent for acetylene is absorbed. The porous mass normally fills the cylinder body, and typically comprises a very porous, concrete-like substance such as calcium metasilicate having an admixture of a suitable fibrous material, for example asbestos, to increase its mechanical strength. The solvent is typically acetone or N,N-dimethylformamide.

From the point of view of safety it is important that the porous mass which fills the body of an acetylene cylinder leave no large cavities within the body wherein acetylene gas can collect and be compressed, causing an explosive decomposition of acetylene to take place. Decomposition of acetylene into its elements can be prevented by minimizing the size of the spaces defined (1) within the porous mass, and (2) between the porous mass and the surrounding internal wall surfaces of the cylinder.

The filling of acetylene cylinders involves problems beyond those normally encountered in filling cylinders with gases other than acetylene. When an acetylene cylinder is returned from a customer, it contains an unknown quantity of residual acetylene gas, and an unknown quantity of solvent. The quantity of solvent remaining in the cylinder is almost always less than the desired nominal amount due to discharge of evaporated solvent from the cylinder as acetylene gas is used by the customer.

The only information which can be ascertained about a returned cylinder by physically inspecting it is whether or not the cylinder appears to be damaged, and such cylinder data as is stamped or otherwise inscribed on the outside of the or on a cap affixed to the cylinder. The cylinder data normally includes a cylinder type designation (which defines the cylinder's internal volume), and the cylinder's "tare weight," i.e., weight of the cylinder together with the weight of the porous mass and the weight of a proper nominal charge of acetone solvent. By weighing a returned cylinder, it is possible to determine the total weight of the cylinder and such solvent and residual gas as remain in the cylinder. By measuring the pressure of the contents of the cylinder, and by taking into account the temperature of the cylinder, the exact quantities of residual gas and solvent which are present in the cylinder can be calculated readily.

In a conventional acetylene cylinder filling process, each cylinder is first physically inspected for possible damage. The contents of the cylinder are then checked with reference to the cylinder's tare weight, pressure and temperature, to determine the quantities of solvent and gas which remain in the cylinder. A calculation is then made to determine the quantities of solvent and gas which should be supplied to refill the cylinder.

In accordance with conventional filling procedures, an acetylene cylinder which has been checked in the manner described above is refilled first by charging it with the requisite amount of missing solvent, and then by introducing the requisite quantity of acetylene gas. The gas is fed to the cylinder at a relatively low pressure during a period of time which extends for many hours. While cylinders are charged on an individual basis to supply them with the requisite quantities of solvent, a plurality of solvent-replenished cylinders are connected together or "ganged" for simultaneous filling with acetylene.

While a cylinder is being filled with acetylene, its temperature is caused to rise due to the high heat of solution of acetylene. Stated in another way, as acetylene gas is dissolved by a cylinder-carried solvent such as acetone, a substantial amount of heat energy is released, causing a marked elevation in the temperature of the cylinder and its contents. As the temperature of the cylinder's contents rises, so too does the pressure within the cylinder. When the pressure within the ganged cylinders reaches approximately 25 bar (about 360 psia), filling is halted because, from a safety point of view, this is considered to be about the highest pressure to which acetylene should normally be compressed. The partially filled cylinders are then left standing to cool.

After a sufficient period of cooling time, the cylinders stabilize in temperature, and can then be further charged with acetylene to complete the filling procedure. The filled cylinders are then disconnected from the filling apparatus and individually weighed to make certain that they contain, within certain tolerances, the prescribed quantity of acetylene. Any cylinders showing excess weight are slightly emptied. Any cylinders which have been insufficiently filled are given an additional filling.

In temperate climates, about seven hours is a normal time for the initial filling of a solvent-charged cylinder with acetylene gas, followed by about a twelve hour pause for cooling, whereafter a final filling with acetylene usually requires about an additional two hours. In hotter climates these filling and cooling times are considerably longer.

In order to diminish filling time, it has been proposed to cool acetylene cylinders during filling by spraying their outer walls with a liquid coolant. The coolant is discharged onto the cylinders from overhead nozzles, and typically comprises either cold water, or a cold antifreeze solution such as a mixture of water and alcohol. The overhead arrangement of spray nozzles causes coolant to flow along the full lengths of the outer walls of the cylinders. Cooling the cylinders during filling not only serves to reduce cylinder filling time, but also enables larger numbers of cylinders to be processed through a filling station, and minimizes the need for extensive banks of filling equipment. Moreover, the cost of labor per filled cylinder is reduced.

3. The Mechanical System Proposal

In order to provide for rapid filling of acetylene cylinders, a mechanical system, hereinafter referred to as the "Mechanical System," has been proposed consisting basically of a relatively complex scale having a programmable weight level which, when reached, will cause the system to transfer from charging a cylinder with acetone to charging the cylinder with acetylene. In utilizing this proposal, an operator positions a cylinder on the scale, reads the tare weight of the cylinder, and inputs that information to the scale together with information regarding the pressure and temperature of the cylinder's contents. Based on this information, a calculation is made as to the quantity of solvent which should be added during filling. The process of replenishing the cylinder with solvent and gas then proceeds, monitored by the scale. As with conventional filling processes, the total required quantity of solvent is replenished first. Only after the entire requisite charge of solvent has been introduced into the cylinder does acetylene filling begin. Acetylene filling continues until such time as a predetermined weight is sensed by the scale, whereupon filling is halted, and the filled cylinder is removed from the scale.

A problem encountered both with conventional filling techniques and with the Mechanical System proposal is the possibility, if not the likelihood, that cylinders will, when filled, contain a higher than desired weight of acetylene, and a lower than desired weight of acetone. Such a situation is undesirable, not only from the point of view of safety, but also from the point of view of cost. Acetylene is far more expensive per pound than is acetone.

The Mechanical System proposal has limitations in accuracy and programmability. By virtue of its mechanical nature, this proposal is limited in use to a weight-monitored filling process wherein the missing weight of solvent is first totally replenished in an initial filling step, whereafter the requisite weight of acetylene supplied in a final filling step. The Mechanical System proposal does not fully address many safety considerations which are desirably taken into account in the rapid filling of acetylene cylinders, and can, in the event of a weight-sensing malfunction, permit a cylinder to be overfilled.

As will be apparent from the description of the present invention which follows, what the present invention has in common with the Mechanical System proposal is individual, rapid, high-pressure filling of cylinders with acetylene while the cylinders are each positioned atop a separate weight-monitoring device, and while outer wall portions of the cylinders are being cooled with a flow of coolant. However, as also will be apparent from the discussion which follows, the system of the present invention provides many advantages over the Mechanical System proposal, including significant advances which enhance the safety and efficiency with which acetylene cylinders are filled.

4. The Referenced Applications

The referenced Fixed Cap Case relates to a protective cap for a pressurized gas cylinder. The cap has cylinder data encoded on it. The Fixed Cap Case also relates to a method and apparatus for reading encoded cylinder data for automatically inputting the data to a control unit. Use is made of the invention described in the Fixed Cap Case in carrying out the preferred practice of the present invention.

The referenced Cooling System Case addresses a problem which has not been recognized previously, namely that the conventional practice of cooling cylinders along the full lengths of their outer walls during filling with acetylene does not provide, from the point of view of safety, an optimum type of cooling. The invention of the Cooling System Case provides for selective cooling of only lower portions of the outer wall of an acetylene cylinder during filling to achieve a highly desirable, non-uniform concentration of dissolved acetylene within a cylinder being filled, with the lowest concentration of dissolved acetylene being in the upper end region of the cylinder, whereby the cylinder's resistance to backfire is significantly enhanced. Use is made of the invention described in the Cooling System Case in carrying out the preferred practice of the present invention.

SUMMARY OF THE INVENTION

The present invention overcomes the foregoing and other drawbacks of previously proposed acetylene cylinder filling systems by providing novel and improved methods and apparatus for rapid filling acetylene cylinders with enhanced safety and efficiency. Utilizing the preferred practice of the present invention, the time required to fill a typical acetylene cylinder can be reduced safely to less than an hour. Utilizing the preferred practice of the present invention, an operator is able, while working at a comfortable pace, to serve each of several closely-spaced filling bays and effect sequential fillings of cylinders in each of the bays at an average rate of about seven kilograms (about 15.4 pounds) at acetylene gas per hour per filling bay.

The system of the present invention establishes a smooth working dialog between a control unit and one or more operators who work in a cylinder filling room. The operators perform initial cylinder hookup procedures as guided and prompted by the control unit. Once an operator has performed certain preliminary cylinder hookup tasks, the control unit then takes over the steps involved in the actual filling of a cylinder, and carries out a desired type of staged introduction of alternate charges of solvent and gas. The control unit monitors all phases of a filling procedure and assists the filling room operators, whenever their help is needed, by guiding and prompting them at a comfortable pace as they perform their required activities.

A significant feature of the invention lies in the use of a control unit to check at frequent intervals for safe filling conditions. If an unsatisfactory or unsafe condition is detected, the control unit gives the operator only a limited period of time in which to properly respond. In the absence of a timely and proper operator response, the control unit begins instituting an appropriate series of emergency procedures. Where appropriate, the control unit will sound a firebrigade alarm and will begin shutting down selected functions of the gas filling plant to minimize danger should the potential for a fire or explosion be present.

Another feature of the invention lies in the provision of a cylinder filling control unit which not only monitors cylinder filling operations to assure safe plant operation, but also collects and records such data as is needed to provide desired types of records and reports.

Moreover, the data recorded by the control unit can assist in pinpointing production and safety concerns, in determining with precision the quantity and quality of such raw materials as are being used in gas production, and in keeping track of the numbers and types of cylinders which are filled during given intervals of time.

Still another feature of the present invention lies in the use of a closely monitored filling system procedure which detects when acetylene is being delivered too rapidly to a cylinder being filled. An undesirably rapid delivery of acetylene is usually indicative of either a defect in the porous mass within the cylinder, or of a leak. Thus, the system of the present invention monitors the filling of acetylene cylinders in such a way as to detect structural detects in the cylinders being filled, and to check for leaks. If an unsafe condition is detected, filling is stopped and an alarm is sounded which requires a timely and proper operator response.

The system of the present invention utilizes the highest accepted safe pressure for filling acetylene cylinders, and carries out a controlled, carefully monitored filling process which is divided into four filling stages, with solvent and gas being injected in alternate sequence into each of the cylinders being filled. The controlled filling procedure is begun after a visually inspected cylinder to be filled is positioned atop a weighing pad in a filling bay. The operator connects a filling hose to the cylinder's supply valve and opens the valve to communicate the cylinder with the filling hose. The operator also attaches a coolant supply device to the cylinder for cooling selected outer wall portions of the cylinder while it is being filled. The weighing pad is connected to the control unit for inputting sensed cylinder weight to the control unit. A pressure sensor is connected to the filling hose to sense the pressure of the contents of the cylinder.

Cylinder data including cylinder volume and tare weight are inputted to the control unit by the operator. As a safety precaution, this information must be inputted twice, and both input efforts must result in the supply of identical data for the control unit to accept the data transmission. Once the inputted cylinder data has been accepted by the control unit, this data is compared with predetermined ranges of possible information for the type of cylinder to be filled to assure that the inputted information is reasonable and falls within acceptable bounds. The sensed weight of the cylinder on the weighing pad is taken into account by the control unit to make certain that it falls within acceptable bounds in comparison with the inputted cylinder data.

If the foregoing checks are approved, the control unit instructs the operator to start the filling procedure by pushing a green-colored button which causes a signal indicative of the sensed pressure of the cylinder's contents to be inputted to the control unit. The control unit checks the sensed pressure of the contents of the cylinder to determine if it is within prescribed limits. If the pressure input is accepted, the information inputted thus far to the control unit is utilized to determine the quantities of acetone and residual gas which remain in the cylinder, and to determine the necessary quantities of solvent and gas which should be added to the cylinder.

An automated filling procedure is then initiated by the control unit, whereupon the operator need no longer attend the filling bay where the automated procedure is being carried out. The control unit starts a supply of coolant to begin the cooling of selected portions of the cylinder's outer walls. Once the weights of the filling hose, the coolant supply device, and the flow of coolant have stabilized and have been taken into account, a staged filling of the cylinder is begun.

Cylinder filling is carried out in four distinct steps or stages, all of which are monitored by the control unit. A first stage involves the addition to the cylinder of a major part of the necessary quantity of solvent. A second stage involves the addition to the cylinder of a major part of the necessary quantity of acetylene gas. A third stage involves the addition to the cylinder of the remaining quantity of required solvent. A fourth and last stage involves the addition to the cylinder of the remaining quantity of required gas. For purposes of discussion, it will be assumed that the solvent supplied during the first and third stages is acetone. While the gas added during the second stage is acetylene, the gas added during the fourth stage may include or consist solely of a gaseous hydrocarbon other than acetylene, such as propane, butane or ethylene. Such hydrocarbon gases are sometimes used to help stabilize the contents of the cylinder.

Several advantages result from the carefully monitored, staged filling process employed with the preferred practice of the present invention. By repeatedly checking cylinder weight and pressure during filling (preferably as often as twice per second) the control unit closely monitors the entire filling process and assures that it is carried out safely and without acetylene leakage. If, during any part of the filling process an abnormal or unacceptable condition is detected, an alarm is sounded which must be dealt with appropriately by an operator within a brief predetermined interval of time. Many of these "alarms" simply require operator acknowledgment and acceptance of a nonstandard, but nonetheless safe deviation from desired filling practice. Operator acknowledgement acceptance is communicated to the control unit by pressing a yellow-colored button located on a filling bay console. In the absence of a timely and proper operator response, the control unit will institute appropriate emergency procedures which may include an emergency shutdown of the entire gas factory and the sounding of a firebrigade alert.

By introducing the solvent in two separate stages, it is assured that, at the completion of the filling process, the upper end region of the porous mass within the cylinder has absorbed within it a more than adequate quantity of solvent to assure a safe cylinder condition in the event of a backfire situation. By making a final check of the contents of a filled cylinder, the safety of the cylinder is assured. When cylinder filling is completed, the control unit signals the operator to remove the filled cylinder from its filling bay. The operator initiates cylinder removal and disconnect procedures by pressing a red button located on the filling bay console.

BRIEF DESCRIPTION OF THE DRAWINGS

The foregoing and other features and advantages, and a fuller understanding of the present invention may be had by referring to the following description and claims, taken in conjunction with the accompanying drawings, wherein:

DESCRIPTION OF THE PREFERRED EMBODIMENT

Figure 1:
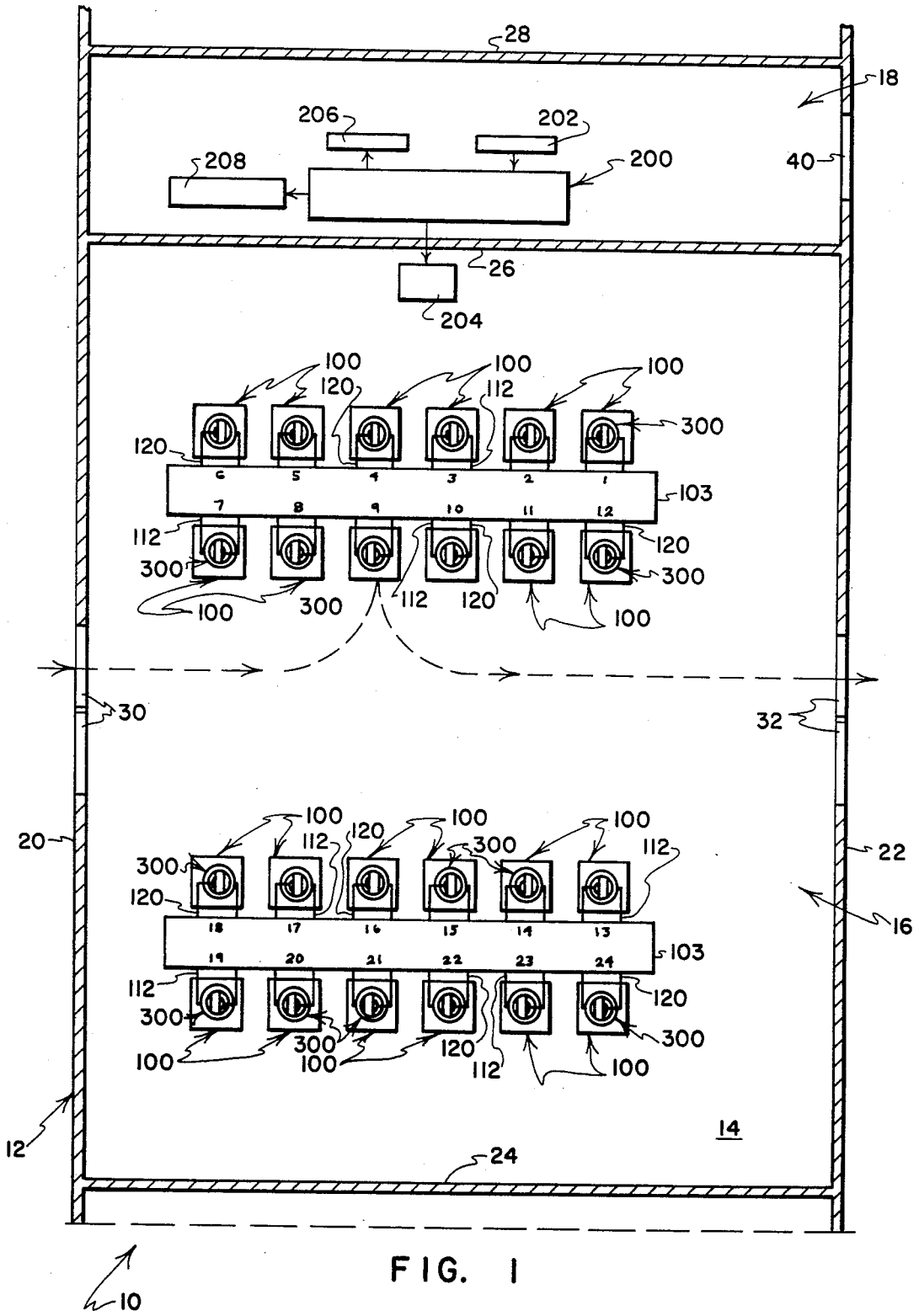
FIG. 1 is a schematic top plan view of portions of a gas factory building, with the roof of the building removed to show how gas cylinder filling bays are preferably arranged in a filling room, and how a control unit is preferably positioned in a separate but nearby room.

Referring to FIG. 1, a general layout of an acetylene cylinder filling station which employs are preferred practice of the present invention is indicated generally by the numeral 10. The station 10 includes a building 12 having a floor 14 and walls which define a filling room 16 and a control room 18. The walls of the building 12 include side walls 20, 22 and traverse walls 24, 26, 28. The transverse walls 24, 26 cooperate with the side walls 20, 22 to define the filling room 16. The transverse walls 26, 28 cooperate with the side walls 20,22 to define the control room 18.

Access doors 30, 32 are provided in the side walls 20, 22. In preferred practice, an orderly flow of cylinders is achieved by utilizing the doors 30 to admit cylinders to be filled to the filling room 16, and by utilizing the doors 32 to remove filled cylinders from the filling room 16. An access door 40 is provided in the side wall 22 to admit authorized personnel to the control room 18. The transverse wall 26 which separates the filling and control rooms 16, 18 is preferably fomred of explosion-resistant, fire-rated material. If desired, the rooms 16, 18 may be further segregated, or even located in separate buildings to prevent the spread of fire from one to the other.

A plurality of cylinder filling bays 100 are defined within the filling room 16. The bays 100 are arranged in paired rows on opposite sides of elongate consoles 103. While the room 16 is shown having two consoles 103 each serving twelve filling bays 100, it will be understood that the number of consoles 103 and the number of filling bays 100 provided in the filling room 16 is a matter of choice.

A control unit 200 is housed in the control room 18. While the control unit 200 could comprise a solid-wired electrical switching system including mechanical relays and the like which are arranged in a conventional fashion to perform various predetermined functions in response to predetermined input signals, the unit 200 preferably comprises a programmable computer which achieves the desired result with greater efficiency and versatility.

The control unit 200 is connected to an input keyboard 202, an output display 204, a recording device 206, and an electrical/pneumatic interface panel 208. The keyboard 202 provides one means which can be used to communicate with the control unit 200. The output display 204 is positioned in the filling room 16 and is used to monitor filling processes and to facilitate communication between the control unit 200 and operators working in the filling room 16. The recording device 206 is utilized to record various types of useful information as cylinder filling progresses, and as a means for outputting various types of logs and reports. The interface panel 208 is a safety device which converts electrical command signals from the central unit 200 to pneumatic signals for actuating supply valves which are housed within the supply consoles 103. Pneumatically-operated valves are utilized in the filling room 16 to assure that no electrically-generated fires or explosions result should acetylene be present in the air within the filling room 16.

Gas cylinders 300 to be filled with acetylene are positioned in the bays 100. Each of the cylinders 300 has a steel housing 302 which, at its upper end carries a valve 304 for controlling the flow of gas and solvent into and out of the steel housing 302. Protective caps 310 are fixed atop each of the cylinders 300. The caps 310 are preferably of the type described in the referenced Fixed Cap Case.

Figure 2:
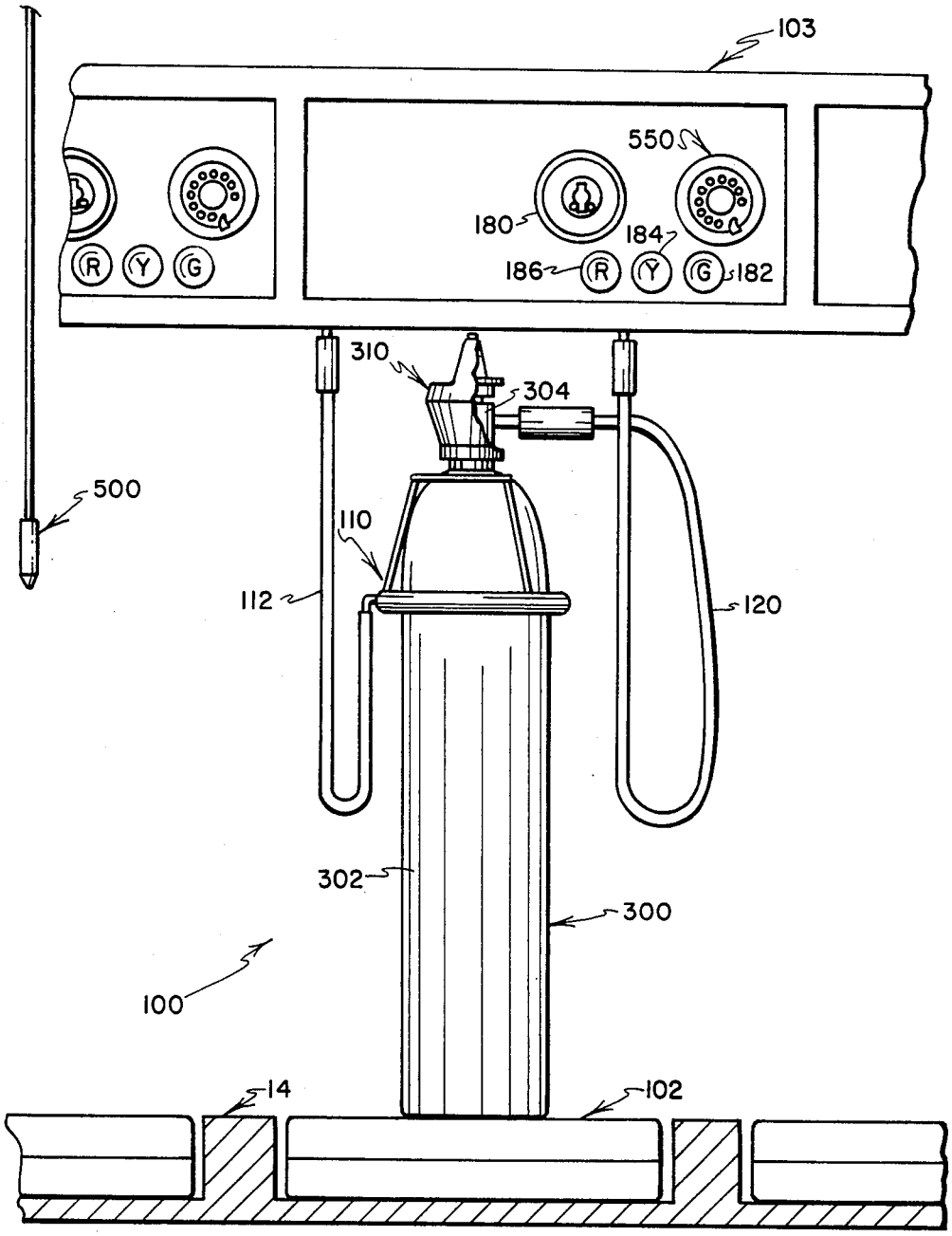
FIG. 2 is a side elevational view, on an enlarged scale, showing a typical cylinder filling bay with a pressurized gas cylinder positioned therein as during filling.
Figure 4:
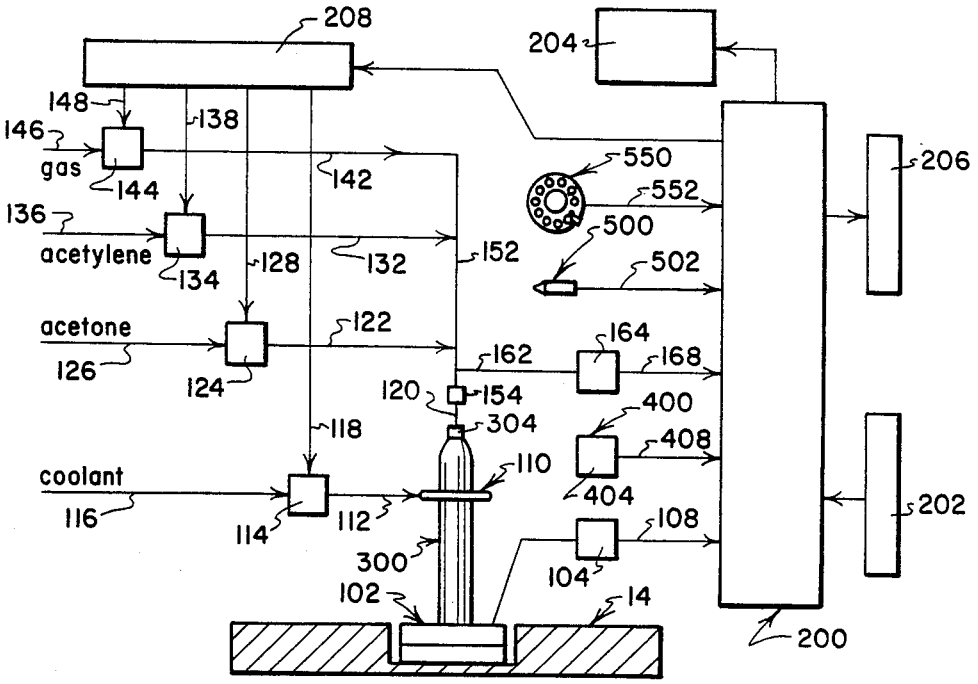
FIG. 4 is a schematic view showing a preferred basic arrangement of components utilized to effect filling of a cylinder positioned in one of the filling bays of FIG. 1.

Referring to FIGS. 2 and 4, each of the bays 100 has a weighing pad 102 which is recessed into the floor 14. The pad 102 forms part of an electronic weighing unit which, as is depicted in FIG. 4, includes a weight sensor 104. The weight sensor 104 is connected to the control unit 200 to input a signal indicative of sensed weight, as indicated by the numeral 108. Each of the bays 100 is also provided with a ring-shaped coolant dispenser 110. The coolant dispenser 110 is preferably of the type prescribed in the reference Cooling System Case. Coolant in the form of cold water or a cold antifreeze solution of water and alcohol, ethylene glycol, or propylene glycol is supplied to the dispenser 110 from a coolant delivery hose 112 through a conduit 116 and a valve 114. The valve 114 is connected to the interface panel 208 to receive actuation signals, as indicated by the numeral 118.

Each of the bays 100 is provided with a filling hose 120 which connects with the valve 304 located atop a cylinder 300 positioned on the bay's weighing pad 102. The filling hose 120 is connected through a valve 154 to a supply conduit 152. The supply conduit 152 is connected by conduits 122, 132, 142 to valves 124, 134, 144. The valve 124 is connected through a acetone supply conduit 126 to a source of pressurized acetone. The valve 134 is connected through an acetylene supply conduit 136 to a source of acetylene gas. The valve 144 is connected through a gas supply conduit 146 to a source of some gaseous hydrocarbon other than acetylene, for example propane, butane or ethylene, a quantity of which may be introduced into the cylinder 300 toward the end of a filling cycle to assist in stabilizing the contents of the cylinder 300. The valves 124, 134, 144 are connected to the interface panel 208, as indicated by the numerals 128, 138, 148, respectively, to receive pneumatic actuation signals. The valves 124, 134, 144 are all of a normally-closed type, such that, in the event of a power failure or a break in a pneumatic control line, valve closure will take place to terminate cylinder filling.

The supply conduit 152 is also connected by a conduit 162 to a pressure sensor 164. The pressure sensor 164 connects with the control unit 200, as is indicated by the numeral 168, to input a signal which is representative of sensed pressure in the supply line 152, and hence in the cylinder 300.

The control unit 200 is also connected to a temperature sensing device 400. The device 400 includes at least one sensor 404 (preferably a plurality of sensors to assure safety through the redundancy) positioned inside one or more control cylinders (not shown) located within the filling room 16 for sensing a temperature which is representative of the temperature of the contents of the cylinder 300. The sensor 404 is connected to the control unit 200 to input a signal which is representative to sensed cylinder temperature, as indicated by the numeral 408.

Referring to FIGS. 2 and 4, the cylinder 300 is shown positioned on the weighing pad 102. The coolant supply manifold 110 is positioned about the outer wall of the cylinder 300 at a location spaced about 200 mm (about 8 inches) downwardly from the upwardly-facing shoulders of the cylinder 300. The manifold 110 serves to spray coolant onto lower wall portions of the outer surface of the cylinder 300, as is described in greater detail in the referenced Cooling System Case. The cylinder valve 304 is connected to a filling hose 120. The supply conduit 152, the valves 114, 124, 134, 144 and the conduits 116, 122, 126, 132, 136, 142, 146 are enclosed in the supply console 103.

Figure 3:
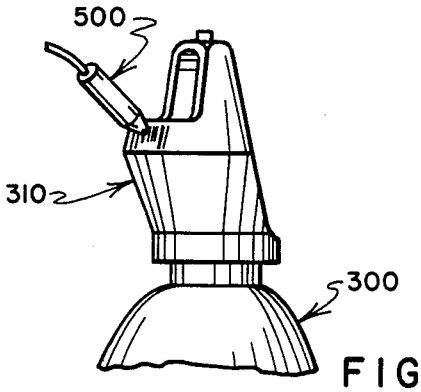
FIG. 3 is a side elevational view, on an enlarged scale, of a portion of the cylinder of FIG. 2 and showing the use of a magnetic sensor to read data encoded on a fixed cap carried by the cylinder.

Referring to FIGS. 2 and 3, a cylinder data reading device 500 is located in proximity to the filling bays 100 for reading cylinder data and inputting this data in the form of a pulsed signal to the control unit 200, as indicated in FIG. 4 by the numeral 502. The device 500 is illustrated as comprising an "electronic pen" having a capability for optically or inductively reading such cylinder data as may be encoded on a neck portion of the cylinder 300, or on the cylinder's protective cap 310. In the preferred practice, the device 500 comprises a dual-head inductive pickup unit of the type described in the referenced Fixed Cap Case. In preferred practice, the encoded data takes the form of a grid of drilled holes of the type described in the referenced Fixed Cap Case.

The console 103 located at each of the cylinder filling bays 100 carries a second type of cylinder-data inputting device in the form of a telephone-type dial 550. The dial 550 may be used in place of the device 500 to manually input cylinder data to the control unit 200, as indicated by the numeral 552 in FIG. 4.

Referring to FIG. 2, the console 103 includes, in addition to the dial 550, a pressure gauge 180, and three control buttons 182, 184, 186. The buttons 182, 184, 186 are colored green, yellow and red, respectively. The green button 182 is used to initiate various filling procedure functions. The yellow button 184 is used to respond to certain types of alarms generated by the control unit 200. The red button 186 is used to stop cylinder filling.

The procedure for filling a cylinder 300 will now be described with reference to FIGS. 2, 4 and 5, the latter of which shows cylinder weight, as sensed by the device 104, as a function of the time throughout an entire filling procedure. When a cylinder 300 is placed on the weighing pad 102, it is weighed, by the pad 102 and a signal representative of its weight is inputted to the control unit 200 as indicated by the numeral 104. The tare data of the cylinder 300 is then inputted to the control unit 200 either by utilizing the automatic reading device 500, or by manually inputting the data using the device 550. The coolant dispenser 310 is attached to the cylinder 300. The filling hose 120 is connected to the cylinder valve 304, and the valve 304 is opened to communicate the cylinder 300 with the filling hose 120. The increased weight of the cylinder 300 with the coolant dispenser 110 and the filling hose 120 attached is inputted by the weighing pad 104 to the control unit 200.

Once the cylinder data and weight has been accepted by the control unit 200, the operator pushes the green button 182 on the console 102 to open the valve 154 so that the pressure of the contents of the cylinder 300 can be sensed by the pressure sensor 164, displayed on the console pressure gauge 180, and inputted to the control unit 200. The control unit 200 checks the pressure signal to make certain that it falls within predetermined safe limits. If the pressure signal is acceptable, the control unit 200 utilizes the information it has received regarding cylinder volume, tare weight and pressure, together with the temperature information inputted from the sensor 404, and determines the quantities of acetone and residual gas which remain in the cylinder 300. The control unit 200 then determines the quantity of acetone necessary to replenish the acetone in the cylinder 300 to the desired nominal level, and the quantity of acetylene gas which is required to refill the cylinder 300.

When the control unit 200 is ready to initiate actual filling of the cylinder, it starts a flow of coolant through the supply hose 112 to the coolant dispenser 110 to cause a curtain of coolant to flow over lower portions of the outer walls of the cylinder 300. Once the flow of coolant has stabilized, the added weight sensed by the weighing pad 102 due to the flow of coolant is transmitted to the control unit 200 and is taken into account so that it will not interfere with sensed weight readings during the filling process. Actual filling of the cylinder 300 starts after these calculations and compensations have been made.

Figure 5:
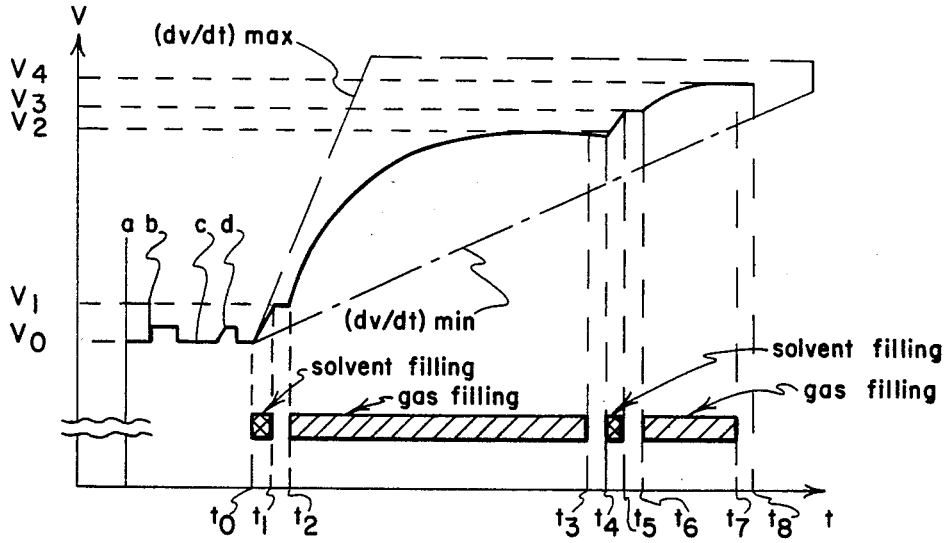
FIG. 5 is a graph depicting a preferred filling sequence in terms of sensed weight of a cylinder being filled as a function of time; and, FIG. 6 is a side elevational view, on an enlarged scale, of a display unit utilized to facilitate interaction between the control unit and one or more operators in the filling room.

Referring to FIG. 5, an initial charge of acetone is pumped into the cylinder at time $t_0$–$t_1$ in response to the sending by the control unit 200 of an actuation signal through the interface panel 208 to the valve 124 to open the valve 124 and thereby communicate the acetone supply conduits 122, 126 with the conduit 152 and with the cylinder filling hose 120. The control unit 200 monitors the charging of the cylinder 300 with acetone and stops the flow of acetone when, as shown in FIG. 5, a predetermined quantity of acetone has been supplied to the cylinder 300.

The quantity of acetone supplied to the cylinder 300 during the initial filling stage $t_0$–$t_1$ is calculated such that it will replenish the cylinder's acetone to within about 400 grams of the requisite nominal cylinder-filled quantity. The reserved amount of acetone is introduced during a third filling stage, as will be explained.

After the initial predetermined quantity of acetone has been pumped into the cylinder 300, the supply of acetone is shut off at time $t_1$, whereafter a tolerance and stability check is carried out in the interval $t_1$–$t_2$. This means that the weight and pressure of the cylinder 300 are measured, and that a check is made to assure that the sensed values of these parameters are within prescribed tolerances. If prescribed tolerances are exceeded, the filling process is interrupted. If the check shows acceptable levels, acetylene filling is started at time $t_2$ in response to the sending by the control unit 200 of an actuation signal through the interface panel 208 to the valve 134 to open the valve 134 and thereby effect communication of the acetylene supply conduits 132, 136 with the conduit 152 and with the filling hose 120.

Acetylene gas is pumped into the cylinder 300 during the interval $t_2$–$t_3$. As already mentioned, the control unit 200 has determined a certain preliminary quantity of gas to be pumped into the cylinder 300. In the example illustrated in FIG. 5, this amount represents about 90% of the total quantity. When this amount has been reached at time $t_3$, the gas supply is cut off by the closing of valve 134 as the result of the control unit 200 sending an actuation signal through the panel interface 208 to the valve 134. After closure of the valve 134, a further tolerance and stability check is conducted. If the results are satisfactory the third stage of filling, namely the further introduction of the reserved quantity of acetone solvent is begun at time $t_4$.

This third stage of filling is begun when the valve 124 is opened as the result of a control signal being sent from the control unit 200 through the panel interface 208 to the valve 124. During the period $t_4$–$t_5$ enough acetone is supplied to the cylinder 300 to complete the filling of the cylinder 300 with the required quantity of acetone. When this procedure has been completed, the valve 124 is closed, and a further tolerance and stability check of the cylinder 300 is carried out in the interval $t_5$–$t_6$. If the result of this check is satisfactory, the fourth and final filling stage is begun.

The fourth stage of filling is begun when the valve 134 is opened as the result of a control signal being sent from the control unit 200 through the panel interface 208 to the valve 134 to initiate supply of the remaining required quantity of acetylene. While, normally the gas supplied during this last stage is acetylene, in some instances it is desirable for some other gaseous hydrocarbon to be introduced into the cylinder 300 during this final filling stage, for example propane, butane or ethylene. Where a gas other than acetylene is to be supplied, the control unit 200 sends a signal through the panel interface 208 to open the valve 144 instead of the valve 134, whereby the gas supply conduits 142, 146 are communicated with the conduit 154 and with the cylinder filling hose 120 to convey the alternate gas to the cylinder 300.

This final filling stage continues until time $t_7$, when the desired quantity of gas has been supplied to the cylinder 300. At this time the connected gas valve 134 or 144, and the coolant supply valve 144 are closed. A final tolerance and stability check is conducted in the interval $t_7$–$t_8$. If the measured values for weight and pressure fall within permissible prescribed values, the filling process is complete and the cylinder 300 is ready to be transported from the filling place. Accordingly, the control unit 200 signals the operator to remove the cylinder 300 from the filling bay 100. With the system of the present invention, a portion of the acetone needed for replenishment can be reserved until the final stage of the filling process to purge the filling hose 120 of fuel gases.

During the filling process the pressure is preferably maintained at the highest permissible filling pressure for an acetylene cylinder, thus generally does not exceed about 25 bar (about 360 psia). This carefully monitored, properly staged high-pressure filling procedure utilized in combination with proper cooling of the cylinder 300 during filling makes possible a safe and efficient filling of the cylinder 300.

Each time during the filling process that a tolerance and stability check is made, the control unit 200 also checks the mechanical functions of the filling system. During these checks, the status and the operability of the various components of the system are checked, for example to assure that a particular valve is in the right position and that there are no leakages. In preferred practice, checks of this type are conducted automatically by the control unit 200 at closely spaced intervals of time, preferably as often as twice per second.

FIG. 5 shows limit lines $(dv/dt)_{max}$ and $(dv/dt)_{min}$ within which the curve representing measured weight as a function of time must remain to assure safe filling. These lines define what may be referred to as dynamic limits for the filling procedure. During cylinder filling, the control unit 200 checks repeatedly to make certain that the filling is proceeding safely within the prescribed dynamic limits as defined by the lines $(dv/dt)_{max}$ and $(dv/dt)_{min}$. If during such checks, an undesirable condition is detected, an alarm is signaled to the operator, through use of the display 204. The operator is then given a predetermined interval of time in which to properly respond. If the operator fails to take proper response measures in this interval of time, the control unit initiates emergency procedures, terminating the filling of one or all of the cylinders 300 in the room 16, as may be appropriate to the particular condition sensed, and initiating an appropriate sequence of emergency procedures.

During the filling process the display 204 presents an array of prompts and messages to operators working within the filling room 16. The display 204 also provides alarm signals of various kinds. A display of this type, if desired, can also be placed in the control room 18 or elsewhere in the gas factory.

Figure 6:
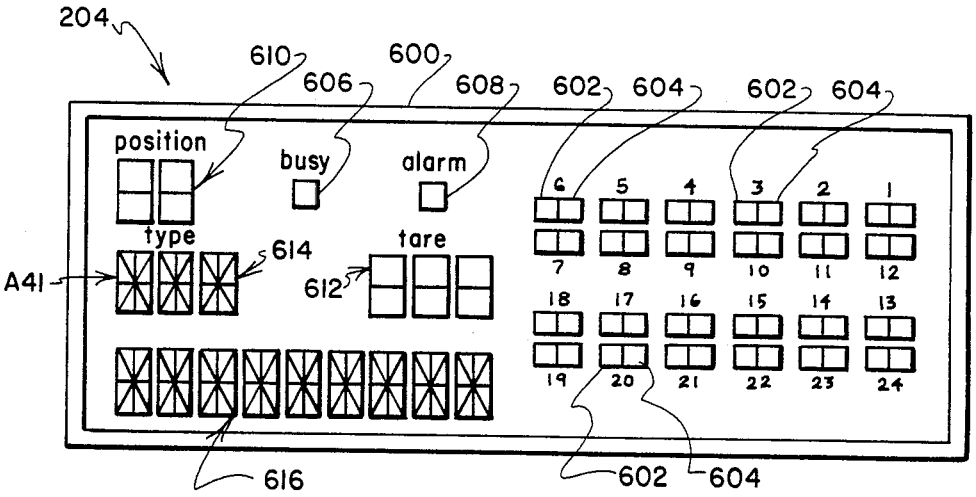

Referring to FIG. 6, the display 204 preferably includes a panel 600 which presents a plurality of indicator lights in combination with alpha-numeric readout devices. The right half of the display 204, as viewed in FIG. 6, is occupied by sets of green and red indicator lights 602, 604, with a separate set of green and red lights provided for each of the twenty-four filling bays 100 depicted in FIG. 1. The left half of the display 204, as viewed in FIG. 6, includes a "busy" light 606, an "alarm" light 608, a two-digit filing bay indicator display 610, a three-digit tare weight display 612, a three-unit alpha-numeric cylinder type indicator display 614, and a nine-unit alpha-numeric text display 616.

With respect to the green and red indicator lights 602, 604, an extinct green lamp indicates a vacant filling position, while a constant green light indicates filling is in progress, and a flashing green light indicates filling is concluded. An extinct red light indicates no alarm, while a constant red light indicates an acknowledged alarm, and a flashing red light indicates an unacknowledged alarm.

The busy light 606 is lighted whenever the control unit 200 is in communication with an operator who is working at a particular filling bay, as during a cylinder hookup procedure. The alarm light 608 is lighted in the event of a sensed impropriety in a filling procedure. The filling bay indicator display 610 indicates the number of a filling bay with which the control unit is in communication. The type and tare indicators 612, 614 provide readouts of inputted cylinder data. The text display 616 presents prompts and status reports to assist operators who are working in the filling room 16.

In the event of failure of the control unit 200 or, if for some reason, it should become necessary, it is possible to change from automated control of filling procedures by the control unit 200 to a complete or partially manual control of the filling process.

As will be apparent from the foregoing description, the described filling system, when compared to conventional filling systems, has the advantage of providing a staged program of acetone replenishment and acetylene filling which is carried out under continuous supervision. A high level of safety results due to a number of factors, including individual monitoring of each cylinder being filled, and a reduction in dependence is made on the skill and responsibility of operators. To further increase safety it is, of course, possible to double certain functions, for example by having two redundant weight sensors at each filling bay, and two redundant pressure sensors at each filling bay.

With the system of the present invention, cylinders are filled to their maximum levels at minimal risk. The number of filling bays 102 needed to achieve a desired output of filled cylinders is greatly diminished in comparison with previously proposed filling systems, as is the area required for cylinder filling. Moreover, the number of personnel needed to operate the system of the present invention is about half that needed to operate a conventional filling facility having about the same or a lesser filling capacity.

Many of the features of the present invention are not limited to use in filling acetylene cylinders. Indeed, utilization of the weight and pressure monitoring controls of the present invention can be made in filling cylinders with many types of gases. As will be described in greater detail in a continuation-in-part of the present application, the weight and pressure controlled filling techniques of the present invention have particularly advantageous use in conjunction with the filling of cylinders with mixed gases.

While the term "cylinder" is used throughout this document in referring to such containers as are being filled or refilled with pressurized gas, it will be understood that this term is used simply to comply with the terminology used by those skilled in the art to which the present invention pertains. The term "cylinder" is not to be construed as being limiting, and applies with equal propriety to all forms of containers which are suitable for use with a particular pressurized gas.

Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention as hereinafter claimed. It is intended that the patent shall cover, by suitable expression in the appended claims, whatever features of patentability exist in the invention disclosed.

What is claimed is:

1. A method of filling a pressurized gas cylinder, comprising the steps of:

(a) introducing a desired quantity of pressurized gas into a pressurized gas cylinder while, at very closely spaced intervals of time, typically about two times per second, through the time while pressurized gas is being introduced into the cylinder:
  (i) sensing the weight of the cylinder and its contents at a given instant of time;
  (ii) sensing the pressure of the contents of the cylinder; and,
  (ii) at substantially the same given instant of time, comparing the sensed weight and pressure values with predetermined acceptable maximum and minimum values which define ranges of acceptability for these sensed values to determine whether the sensed values continue to lie within the predetermined ranges of acceptability; and, (b) at substantially the same given instant of time, effecting an interruption of the introduction of gas into the cylinder as a result of the sensed values being found to lie outside the predetermined ranges of acceptability.

2. The method of claim 1 additionally including the step of signaling an operator in response to a sensing of values which lie outside the predetermined ranges of acceptability.

3. A method of filling a pressurized gas cylinder, comprising the steps of:

(a) introducing a desired quantity of pressurized gas into a pressurized gas cylinder while:
  (i) monitoring the weight of the cylinder and its contents;
  (ii) monitoring the pressure of the contents of the cylinder; and,
  (iii) comparing the monitored weight and pressure values with predetermined acceptable maximum and minimum values which define ranges of acceptability for these monitored values to determine whether the monitored values continue to lie within the predetermined ranges of acceptability; and, (b) interrupting the introduction of gas into the cylinder if, at any time during its introduction, the monitored values are found to lie outside the predetermined ranges of acceptability;

(c) signaling an operator in response to a sensing of monitored values lie outside the predetermined ranges of acceptability; and, (d) initiating a predetermined emergency prodecure in response to the sensing of monitored values which lie outside the predetermined ranges of acceptability, unless an operator initiates a predetermined response within a predetermined interval of time as measured from the initiation of the step of signalling the operator.

4. The method of claim 3 wherein the step of initiating an emergency procedure includes the step of terminating the supply of pressurized gas to the cylinder.

5. The method of claim 3 wherein the step of initiating an emergency procedure includes the step of signalling a firebrigade alarm.

6. A method of filling a pressurized gas cylinder, comprising the steps of:

(a) introducing a desired quantity of pressurized gas into a pressurized gas cylinder while:
  (i) monitoring the weight of the cylinder and its contents;
  (ii) monitoring the pressure of the contents of the cylinder; and,
  (iii) comparing the monitored weight and pressure values with predetermined acceptable maximum and minimum values which define ranges of acceptability for these monitored values to determine whether the monitored values continue to lie within the predetermined ranges of acceptability; and, (b) interrupting the introduction of gas into the cylinder if, at any time during its introduction, the monitored values are found to lie outside the predetermined ranges of acceptability;

(c) signaling an operator in response to a sensing of monitored values which lie outside the predetermined ranges of acceptability;
(d) measuring the initial weight of the cylinder and its contents;
(e) measuring the initial pressure of the contents of the cylinder;
(f) comparing the measured initial weight and pressure values with predetermined acceptable maximum and minimum values which define acceptable ranges of safety for these measured values with respect to the type of cylinder to be filled to determine whether the measured initial values lie within the predetermined ranges of safety for the cylinder to be filled; and,
(g) permitting the step of introducing gas into the cylinder to begin only in the event that the measured initial weight and pressure values are found to lie within the predetermined ranges of safety.

7. The method of claim 6 additionally including the step of signalling an operator in response to sensing of initial values which lie outside the predetermined ranges of safety.

8. The method of claim 7 additionally including the step of initiating a predetermined emergency procedure in response to the sensing of initial values which lie outside the predetermined ranges of safety, unless an operator initiates a predetermined response within a predetermined interval of time as measured from the initiation of the step of signalling an operator.

9. The method of claim 7 wherein the step of initiating an emergency procedure includes the step of signalling a firebrigade alarm.

10. A method of initiating filling of a pressurized gas cylinder, comprising the steps of:
(a) positioning a pressurized gas cylinder to be filled atop a weight-sensing device;
(b) measuring the initial weight of the cylinder and its contents;
(c) connecting a filling conduit to the cylinder such that the conduit communicates with the cylinder;
(d) measuring the initial pressure of the contents of the cylinder by measuring the pressure within the connected filling conduit;
(e) comparing the measured initial weight and pressure values with predetermined acceptable maximum and minimum values which define acceptable ranges of safety for these measured values with respect to the type of cylinder being filled to determine whether the measured initial values lie within the predetermined ranges of safety for the cylinder to be filled; and,
(d) initiating an introduction into the cylinder through the filling conduit of a first desired material if, and only if, the measured initial weight and pressure values are found to lie within the predetermined ranges of safety.

11. The method of claim 10 additionally including the step of signalling an operator in response to sensing of initial values which lie outside the predetermined ranges of safety.

12. The method of claim 11 additionally including the step of initiating a predetermined emergency procedure in response to the sensing of initial values which lie outside the predetermined ranges of safety, unless an operator initiates a predetermined response within a predetermined interval of time as measured from the initiation of the step of signalling an operator.

13. The method of claim 11 wherein the step of initiating an emergency procedure includes the step of signalling a firebrigade alarm.

14. The method of claim 10 additionally including the steps of:
(a) monitoring the introduction into the cylinder of the first material by measuring the weight of the cylinder and its contents, and by monitoring the pressure of the contents of the cylinder by monitoring the pressure within the filling conduit;
(b) comparing the monitored weight and pressure values with predetermined acceptable maximum and minimum values which define ranges of acceptability for these monitored values to determine whether the monitored values continue to lie within the predetermined ranges of acceptability; and,
(c) interrupting the introduction into the cylinder of the first material if, at any time during its introduction, the monitored values are found to lie outside the predetermined ranges of acceptability.

15. The method of claim 14 additionally including the step of signaling an operator in response to sensing of monitored values which lie outside the predetermined ranges of acceptability.

16. The method of claim 15 additionally including the step of initiating a predetermined emergency procedure in response to the sensing of monitored values which lie outside the predetermined ranges of acceptability, unless an operator initiates a predetermined response within a predetermined interval of time as measured from the initiation of the step of signalling the operator.

17. The method of claim 16 wherein the step of initiating an emergency procedure includes the step of signalling a firebrigade alarm.

18. The method of claim 10 additionally including the steps of:
(a) determining the quantity of a first material introduced into the cylinder by the weight of the cylinder and its contents and subtracting therefrom the initial weight of the cylinder and its contents;
(b) comparing the determined weight of the first material which has been introduced into the cylinder with a predetermined weight of first material which is desired to be introduced into the cylinder; and,
(c) terminating the introduction of the first material into the cylinder when the determined weight of the first material which has been introduced into the cylinder is found to be as great in magnitude as the predetermined weight of first material which is desired to be introduced.

19. The method of claim 18 additionally including the steps of:
(a) measuring the weight of the cylinder and its contents at a time after the step of introduction into the cylinder of the first material has been concluded;
(b) measuring the pressure of the contents of the cylinder at a time after the step of introduction into the cylinder of the first material has been concluded;
(c) comparing these measured weight and pressure values with predetermined acceptable maximum and minimum values which define permissible ranges for such measured values with respect to the size and configuration of the cylinder that is being filled to determine whether such measured values lie within the predetermined permissible ranges for the cylinder being filled; and, (d) initiating an introduction into the cylinder through the filling conduit of a second desired material if, and only if, such measured weight and pressure values are found to lie within the predetermined permissible ranges for the cylinder being filled.

20. The method of claim 19 additionally including the step of signalling an operator in response to sensing of such measured values which lie outside the predetermined permissible ranges.

21. A method of initiating filling of a pressurized gas cylinder, comprising the steps of:

(a) positioning a pressurized gas cylinder to be filled atop a weight-sensing device;

(b) measuring the initial weight of the cylinder and its contents;

(c) connecting a filling conduit to the cylinder such that the conduit communicates with the cylinder;

(d) measuring the initial pressure of the contents of the cylinder by measuring the pressure within the connected filling conduit;

(e) comparing the measured initial weight and pressure values with predetermined acceptable maximum and minimum values which define acceptable ranges of safety for these measured values with respect to the type of cylinder being filled to determine whether the measured initial values lie within the predetermined ranges of safety for the cylinder to be filled;

(f) initiating an introduction into the cylinder through the filling conduit of a first desired material if, and only if, the measured initial weight and pressure values are found to lie within the predetermined ranges of safety;

(g) determining the quantity of a first material introduced into the cylinder by the weight of the cylinder and its contents and subtracting therefrom the initial weight of the cylinder and its contents;

(h) comparing the determined weight of the first material which has been introduced into the cylinder with a predetermined weight of first material which is desired to be introduced into the cylinder;

(i) terminating the introduction of the first material into the cylinder when the determined weight of the first material which has been introduced into the cylinder is found to be as great in magnitude as the predetermined weight of first material which is desired to be introduced;

(j) measuring the weight of the cylinder and its contents at a time after the step of introduction into the cylinder of the first material has been concluded;

(k) measuring the pressure of the contents of the cylinder at a time after the step of introduction into the cylinder of the first material has been concluded;

(l) comparing these measured weight and pressure values with predetermined acceptable maximum and minimum values which define permissible ranges for such measured values with respect to the size and configuration of the cylinder that is being filled to determine whether such measured values lie within the predetermined permissible ranges for the cylinder being filled; and, (m) initiating an introduction into the cylinder through the filling conduit of a second desired material if, and only if, such measured weight and pressure values are found to lie within the predetermined permissible ranges for the cylinder being filled, (n) signalling an operator in response to sensing of such measured values which lie outside the predetermined permissible ranges; and, (o) initiating a predetermined emergency procedure in response to the sensing of such values which lie outside the predetermined permissible ranges, unless an operator initiates a predetermined response within a predetermined interval of time as measured from the initiation of the step of signalling an operator.

22. The method of claim 19 additionally including the steps of:

(a) monitoring the introduction into the cylinder of the second material by measuring the pressure within the filling conduit;

(b) comparing the measured pressure value with predetermined permitted maximum and minimum pressure values which define a permitted range for the monitored values to determine whether the measured pressure value lies within the permitted range; and, (c) interrupting the introduction into the cylinder of the second material if, at any time during its introduction, the monitored pressure value is found to lie outside the range.

23. The method of claim 22 additionally including the step of signaling an operator in response to a sensing of a measured value which lies outside the permitted range.

24. The method of claim 23 additionally including the step of initiating a predetermined emergency procedure in response to the sensing of a measured value which lies outside the permitted range, unless an operator initiates a predetermined action within a predetermined interval of time as measured from the initiation of the step of signalling the operator.

25. The method of claim 23 wherein the step of initiating an emergency procedure includes the step of signalling a firebrigade alarm.

26. A method of filling acetylene gas into a pressurized gas cylinder of the type which contains a porous mass with a solvent absorbed therein for dissolving acetylene, comprising the steps of:

(a) determining the necessary quantity of solvent and the necessary quantity of acetylene gas which should be added to the cylinder to properly refill it;

(b) filling the cylinder with the necessary quantities of solvent and acetylene gas in a sequence of filling stages wherein:

(i) a first stage includes introducing into the cylinder a first portion of the necessary quantity of solvent;

(ii) a second usage includes introducing into the cylinder a first portion of the necessary quantity of acetylene gas;

(iii) a third stage includes introducing into the cylinder the remaining portion of the necessary quantity of solvent; and, (iv) a fourth stage includes introducing into the cylinder the remaining portion of the necessary quantity of gas, with the gas being introduced during this stage being selected from a group consisting of acetylene and such gases as have a compatibility with acetylene to assist in stabilizing the contents of a cylinder of acetylene gas.

27. The method of claim 26 wherein, during the sequence of filling stages, filling is monitored by:
(a) monitoring the weight of the cylinder and its contents;
(b) monitoring the pressure of the contents of the cylinder; and,
(c) comparing the monitored values with predetermined maximum and minimum safe values which define ranges of safe values to assure that the monitored values remain within predetermined ranges of safety.

28. The method of claim 27 additionally including the step of stopping the filling of the cylinder at any time during the filling stages when the monitored values are found to lie outside the predetermined ranges of safety.

29. The method of claim 28 additionally including the step of signaling an operator in response to sensing of a monitored value which lies outside the predetermined ranges of safety.

30. The method of claim 28 additionally including the step of initiating a predetermined emergency procedure in the event an operator fails to respond to the signal by taking a predetermined action within a predetermined interval of time.

31. The method of claim 26 wherein the necessary quantity of solvent that is introduced during the first and third stages is a quantity in excess of 400 grams, and the first stage introduction of solvent includes introducing all but about 400 grams of the necessary quantity of solvent.

32. The method of claim 31 wherein the third stage introduction includes a two-part injection of said all but about 400 grams of the necessary quantity of solvent, with the final part of the two-part injection being utilized to purge the fourth stage gas from such supply line as is used to introduce gas and solvent into the cylinder.

33. The method of claim 26 additionally including the step of checking the mechanical functions of the filling system at the end of each of the first, second and third stages.

34. A method of initiating filling of a pressurized gas cylinder with acetylene gas and a solvent, comprising the steps of:
(a) measuring the initial weight of a cylinder to be filled with acetylene, together with the contents of the cylinder;
(b) generating a signal which is representative of measured weight, and inputting the weight-representative signal to a control unit;
(c) measuring the pressure of the contents of the cylinder;
(d) generating a signal which is representative of measured pressure, and inputting the pressure-representative signal to the control unit;
(e) generating a signal which is representative of cylinder data including cylinder volume and tare weight, and inputting the cylinder-data-representative signal to the control unit; and,
(f) utilizing the control unit to compare the character of the pressure-representative and weight-representative signals with predetermined permissible range of relationships for such signals, and permitting gas and solvent to be introduced into the cylinder if, and only if, the character of such signals falls within the permissible range.

35. The method of claim 34 wherein gas and solvent are introduced into the cylinder in a sequence of stages wherein:
(a) a first stage includes introducing into the cylinder a first portion of the necessary quantity of solvent;
(b) a second stage includes introducing into the cylinder a first portion of the necessary quantity of acetylene gas;
(c) a third stage includes introducing into the cylinder the remaining portion of the necessary quantity of solvent; and,
(d) a fourth stage includes introducing into the cylinder the remaining portion of the necessary quantity of gas, with the gas being introduced during this stage being selected from a group consisting of acetylene and such gases as have a compatibility with acetylene to assist in stabilizing the contents of a cylinder of acetylene gas.

36. The method of claim 35 wherein the necessary quantity of solvent that is introduced during the first and third stages is a quantity in excess of 400 grams, and the first stage introduction of solvent includes introducing all but about 400 grams of the necessary quantity of solvent.

37. The method of claim 36 wherein the third stage introduction includes a two-part injection of said all but about 400 grams of the necessary quantity of solvent, with the final part of the two-part injection being utilized to purge the fourth stage gas from such supply line as is used to introduce gas and solvent into the cylinder.

38. A method of increasing safety in the filling of acetylene gas into a cylinder of the type which contains a porous mass having a solvent for acetylene absorbed therein, comprising the steps of:
(a) spraying outer walls of the cylinder continuously with a coolant;
(b) determining the necessary quantities of solvent and gas to be added to the cylinder to effect proper filling;
(c) filling the cylinder with the needed quantities of gas and solvent utilizing a staged filling process divided into four periods with a first period embracing the charging of the cylinder with the major part of the necessary quantity of solvent, a second period wherein the cylinder is charged with the major part of the necessary quantity of gas, a third period wherein the cylinder is charged with the remaining quantity of needed solvent, and a fourth period wherein the cylinder is charged with the remaining quantity of gas; and,
(d) checking the contents of the cylinder at the end of each of the first three periods to see that the measured values for weight and pressure fall within the permissible limit values before the next period of the process is started.

39. The method of claim 38 additionally including the step of interrupting the filling process in the event that any of the checking procedures discloses impermissible deviations from predetermined prescribed limit values.

40. The method of claim 38 additionally including the step of checking the mechanical functions of the filling system at the end of the first three periods.

41. The method of claim 38, wherein, during the four periods of the filling process, the pressure within the cylinder is kept mainly at a substantially constant level corresponding to the maximum filling pressure for the container.

42. The method of claim 38 wherein about 80% of the necessary quantity of solvent is introduced during the first period.

43. The method of claim 38, wherein about 90% of the necessary quantity of gas is introduced during the second period.

44. The method of claim 38 wherein, during the fourth period, at least one gaseous hydrocarbon other than acetylene is introduced into the cylinder.

45. The method of claim 44 wherein the gaseous hydrocarbon is selected from the group consisting of ethylene, butane and propane.

46. A method of filling an acetylene gas cylinder of the type which has a porous mass housed within a pressure vessel, with a solvent for acetylene absorbed in the porous mass, comprising the steps of:

(a) determining the requisite quantities of solvent and acetylene gas which ultimately must be added to the cylinder to fill it;

(b) introducing a first quantity of solvent into the cylinder which equals the ultimate requisite quantity of solvent that is greater than 400 grams, less a reserve quantity of about 400 grams;

(c) introducing a first quantity of acetylene into the cylinder at a time after the first quantity of solvent has been introduced into the cylinder, wherein the first quantity of acetylene equals a majority of the requisite quantity of acetylene;

(d) introducing the reserve quantity of solvent into the cylinder at a time after the first quantity of acetylene has been introduced into the cylinder; and, (e) introducing into the cylinder a gaseous hydrocarbon in sufficient quantity to properly complete the filling of the cylinder.

47. The method of claim 46 wherein a portion of the reserve quantity of solvent is injected into the cylinder after the introduction of the gaseous hydrocarbon in order that such portion of the solvent can purge the gaseous hydrocarbon from such supply conduit as is utilized to fill the cylinder.

48. A method of inputting first and second substances into a pressurized gas cylinder, comprising the steps of:

(a) initiating a flow of a first substance into a pressurized gas cylinder;

(b) monitoring the weight of the cylinder and its contents during the introduction of the first substance, and terminating the introduction of the first substance when the monitored weight of the cylinder and its contents indicates that a desired first quantity of the first substance has been introduced into the cylinder;

(c) at a time after the completion of the introduction of the desired first quantity of the first substance, initiating a flow of a second substance into the cylinder; and (d) monitoring the pressure of the contents of the cylinder during the introduction of the second substance, and terminating the introduction of the second substance when the monitored pressure of the contents of the cylinder indicates that a desired preliminary quantity of the second substance has been introduced into the cylinder.

49. A method of inputting first and second substances into a pressurized gas cylinder, comprising the steps of:

(a) initiating a flow of a first substance into a pressurized gas cylinder;

(b) monitoring the weight of the cylinder and its contents during the introduction of the first substance, and terminating the introduction of the first substance when the sensed weight of the cylinder and its contents indicates that a desired first quantity of the first substance has been introduced into the cylinder;

(c) at a time after the completion of the introduction of the desired first quantity of the first substance, initiating a flow of a second substance into the cylinder;

(d) monitoring the pressure of the contents of the cylinder during the introduction of the second substance, and terminating the introduction of the second substance when the sensed pressure of the contents of the cylinder indicates that a desired preliminary quantity of the second substance has been introduced into the cylinder;

(e) monitoring the pressure of the contents of the cylinder and monitoring the weight of the cylinder and its contents throughout the introduction of the first and second materials into the cylinder, and comparing these monitored values with predetermined safe maximum and minimum limits to sense whether filling of the cylinder is proceeding safely.

50. The method of claim 49 additionally including the step of terminating cylinder filling in the event that the monitored values are found to lie outside the predetermined limits.

51. Apparatus for initiating filling of a pressurized gas cylinder to store acetylene gas therein, comprising:

(a) a weight-sensing device for receiving a pressurized gas cylinder to be filled and for measuring the initial weight of the cylinder and its contents;

(b) a filling conduit for connection to a cylinder which is received by the weight-sensing devices;

(c) means for measuring the initial pressure of the contents of the cylinder by measuring the pressure within the connected filling conduit;

(d) means for comparing the measured initial weight and pressure values with predetermined acceptable maximum and minimum values which define acceptable ranges of safety for these measured values with respect to the type of cylinder being filled to determine whether the measured initial values lie within the predetermined ranges of safety for the cylinder to be filled; and, (e) means for initiating an introduction into the cylinder through the filling conduit of a first desired material if, and only if, the measured initial weight and pressure values are found to lie within the predetermined ranges of safety.

52. The apparatus of claim 51 additionally including means for signalling an operator in response to sensing of initial values which lie outside the predetermined ranges of safety.

53. The apparatus of claim 51 additionally including means for initiating a predetermined emergency procedure in response to the sensing of initial values which lie outside the predetermined ranges of safety.

54. The apparatus of claim 51 wherein:

(a) the weight-sensing device includes means for monitoring the introduction into the cylinder of the first material by measuring the weight of the cylinder its contents; and, (b) the pressure-sensing means is operable to monitor the pressure of the contents of the cylinder during filling by monitoring pressure within the filling conduit.

55. The apparatus of claim 51 additionally including means for:

(a) determining the quantity of a first material introduced into the cylinder by the weight of the cylinder and its contents and subtracting therefrom the initial weight of the cylinder and its contents;

(b) comparing the determined weight of the first material which has been introduced into the cylinder with a predetermined weight of first material which is desired to be introduced into the cylinder; and, (c) terminating the introduction of the first material into the cylinder when the determined weight of the first material which has been introduced into the cylinder is found to be as great in magnitude as the predetermined weight of first material which is desired to be introduced.

56. Apparatus for initiating filling of a pressurized gas cylinder to store acetylene gas therein, comprising:

(a) a weight-sensing device for receiving a pressurized gas cylinder to be filled and for measuring the initial weight of the cylinder and its contents;

(b) a filling conduit for connection to a cylinder which is received by the weight-sensing devices;

(c) means for measuring the initial pressure of the contents of the cylinder by measuring the pressure within the connected filling conduit;

(d) means for comparing the measured initial weight and pressure values with predetermined acceptable maximum and minimum values which define acceptable ranges of safety for these measured values with respect to the type of cylinder being filled to determine whether the measured initial values lie within the predetermined ranges of safety for the cylinder to be filled;

(e) means for:

(i) determining the quantity of a first material introduced into the cylinder by the weight of the cylinder and its contents and subtracting therefrom the initial weight of the cylinder and its contents;

(ii) comparing the determined weight of the first material which has been introduced into the cylinder with a predetermined weight of first material which is desired to be introduced into the cylinder; and, (iii) terminating the introduction of the first material into the cylinder when the determined weight of the first material which has been introduced into the cylinder is found to be as great in magnitude as the predetermined weight of first material which is desired to be introduced; and (f) means for:

(i) measuring the weight of the cylinder and its contents following the conclusion of the introduction of the first material;

(ii) measuring the pressure of the contents of the cylinder following the conclusion of the introduction of the first material;

(iii) comparing these measured weight and pressure values with predetermined acceptable maximum and minimum values which define permissible ranges for such measured values with respect to the type of cylinder being filled to determine whether such measured values lie within the predetermined permissible ranges of the cylinder being filled; and, (iv) initiating an introduction into the cylinder through the filling conduit of a second desired material if, and only if, such measured weight and pressure values are found to lie within the predetermined permissible ranges for the cylinder being filled.

57. The apparatus of claim 56 additionally including means for signalling an operator in response to sensing of such measured values which lie outside the predetermined permissible ranges.

58. The apparatus of claim 56 additionally including means for:

(a) monitoring the introduction into the cylinder of the second material by measuring the pressure within the filling conduit; and, (b) comparing the measured pressure value with predetermined permitted maximum and minimum pressure values which define a permitted range for the monitored values to determine whether the measured pressure values lies within the permitted range.

59. The apparatus of claim 58 additionally including means for interrupting the introduction into the cylinder of the second material if, at any time during its introduction, the monitored pressure value is found to lie outside the range.

60. Apparatus for initiating filling of a pressurized gas cylinder with acetylene gas and a solvent, comprising:

(a) means for measuring the initial weight of a cylinder to be filled with acetylene, together with the contents of the cylinder;

(b) means for generating a signal which is representative of measured weight, and inputting the weight-representative signal to a control unit;

(c) means for measuring the pressure of the contents of the cylinder;

(d) means for generating a signal which is representative of measured pressure, and inputting the pressure-representative signal to the control unit;

(e) means for generating a signal which is representative of cylinder data including cylinder volume and tare weight, and inputting the cylinder-data-representative signal to the control unit; and, (f) means for utilizing the control unit to compare the character of the pressure-representative and weight-representative signals with predetermined permissible range of relationships for such signals, and permitting gas and solvent to be introduced into the cylinder if, and only if, the character of such signals falls within the permissible range.

61. The apparatus of claim 60 additionally including means for introducing gas and solvent into a pressurized cylinder in a sequence of stages wherein:

(a) a first stage includes introducing into the cylinder a first portion of the necessary quantity of solvent;

(b) a second stage includes introducing into the cylinder a first portion of the necessary quantity of acetylene gas;

(c) a third stage includes introducing into the cylinder the remaining portion of the necessary quantity of solvent; and, (d) a fourth stage includes introducing into the cylinder the remaining portion of the necessary quantity of gas, with the gas being introduced during this stage being selected from a group consisting of acetylene and such gases as have a compatibility with acetylene to assist in stabilizing the contents of a cylinder of acetylene gas.

62. Apparatus for filling acetylene gas into a cylinder of the type which contains a porous mass having a solvent for acetylene absorbed therein, comprising:

(a) means for spraying outer walls of the cylinder continuously with a coolant;

(b) means for determining the necessary quantities of solvent and gas to be added to the cylinder to effect proper filling;

(c) means for filling the cylinder with the needed quantities of gas and solvent utilizing a staged filling process divided into four periods with a first period embracing the charging of the cylinder with the major part of the necessary quantity of solvent, a second period wherein the cylinder is charged with the major part of the necessary quantity of gas, a third period wherein the cylinder is charged with the remaining quantity of needed solvent, and a fourth period wherein the cylinder is charged with the remaining quantity of gas; and, (d) means for checking the contents of the cylinder at the end of each of the first three periods to see that the measured values for weight and pressure fall within the permissible limit values before the next period of the process is started.

63. Apparatus for filling a pressurized gas cylinder, including:

(a) structure defining a filling bay for receiving a pressurized gas cylinder to be filled;

(b) filling means for connecting with a pressurized gas cylinder positioned in the filling bay to introduce at least one gaseous material into the cylinder;

(c) weighing means for supporting a pressurized gas cylinder positioned in the filling bay and for generating a signal which is indicative of the sensed weight of the cylinder and its contents;

(d) pressure sensing means for providing a signal which is indicative of sensed pressure of the contents of a cylinder positioned in the filling bay; and, (e) control means for receiving the weight-representative and pressure-representative signals and for making repetitive, periodic comparisons, during cylinder filling, of the values of such signals with predetermined values which define limits of safe ranges for such signals as filling of the cylinder progresses.

64. The apparatus of claim 63 additionally including means for supplying coolant to flow along selected outer wall portions of a cylinder being filled in the filling bay to cool the selected outer wall portions.

65. The apparatus of claim 63 additionally including data transmission means located in proximity to the filling bay for providing a pulsed signal indicative of predetermined features of a cylinder positioned in the filling bay.

66. The apparatus of claim 63 wherein the data transmission means includes means for directly reading formations encoded on a cylinder positioned in the filling bay, and for providing a signal to the control unit which is indicative of the encoded cylinder data.

67. The apparatus of claim 63 wherein the filling means includes:

(a) a flexible filling conduit which is connectable to a cylinder positioned in the filling bay for communicating with the cylinder; .

(b) pneumatically-operated valve means for communicating the flexible filling conduit with a source of pressurized gas in response to receipt of a pneumatic actuation signal; and, (c) pneumatic signalling means operable in response to receipt of a control signal from the control unit to supply a pneumatic actuation signal to the valve means.

68. The apparatus of claim 67 wherein the pneumatically-operated valve means is a normally-closed valve which opens only in response to receipt of a positive-pressure pneumatic signal.

69. The apparatus of claim 63 wherein the control unit includes means for monitoring the pressure-representative and weight-representative signals in a coordinated fashion to determine when the filling means is supplying pressurized gas at an excessive rate which is indicative of an improper filling procedure.

70. The apparatus of claim 63 additionally including display means for receiving data from the control unit and displaying it for viewing by an operator, and for indicating an alarm condition when the pressure-representative and weight-representative weight signals are found to lie outside a predetermined range of safety for such signals.

* * * * *